US009611064B2

(12) United States Patent
Bellamah

(10) Patent No.: US 9,611,064 B2
(45) Date of Patent: Apr. 4, 2017

(54) TWO CAN PACK SLEEVE AND METHOD

(71) Applicant: ALTRIA CLIENT SERVICES INC., Richmond, VA (US)

(72) Inventor: Stephen J. Bellamah, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 14/755,167

(22) Filed: Jun. 30, 2015

(65) Prior Publication Data

US 2015/0298849 A1 Oct. 22, 2015

Related U.S. Application Data

(63) Continuation of application No. PCT/US2013/076358, filed on Dec. 19, 2013.
(Continued)

(51) Int. Cl.
*B65D 5/04* (2006.01)
*B65D 71/40* (2006.01)
(Continued)

(52) U.S. Cl.
CPC ..... *B65D 5/04* (2013.01); *A24F 23/00* (2013.01); *B65B 5/08* (2013.01); *B65B 7/20* (2013.01);
(Continued)

(58) Field of Classification Search
CPC ..... A24F 23/00; B65D 5/02; B65D 5/0209; B65D 5/04; B65D 5/18; B65D 5/42;
(Continued)

(56) References Cited

U.S. PATENT DOCUMENTS 2,062,539 A * 12/1936 Vogt ..... B65D 71/38 206/526
2,554,190 A * 5/1951 Hennessey ..... B65D 5/5021 206/429

(Continued)

OTHER PUBLICATIONS

Notification of Transmittal of the International Search Report (Form PCT/ISA/220 and Form PCT/ISA/210) and the Written Opinion of the International Searching Authority (Form PCT/ISA/237) issued on Apr. 29, 2014, in corresponding International Application No. PCT/US2013/076358. (11 pgs).

*Primary Examiner* — Bryon Gehman
(74) *Attorney, Agent, or Firm* — Buchanan Ingersoll & Rooney PC

(57) ABSTRACT

A method of packaging two cylindrical cans having the same height and diameter includes partially erecting a sleeve from a blank so as to have a single opening at the bottom of the sleeve; arranging the two cylindrical cans side-by-side in the partially erected sleeve such that a side of each cylindrical can extends beyond an outer periphery of the sleeve; securing the cans in the sleeve by folding a cross-panel over the opening at a location between the two cans such that the opening is divided into two smaller openings sized to prevent the cans from passing therethrough; and wherein a measured distance from the cross-panel to a side panel of the sleeve in the two smaller openings is less than a diameter of one of the cylindrical cans.

20 Claims, 2 Drawing Sheets

Related U.S. Application Data

(60) Provisional application No. 61/747,639, filed on Dec. 31, 2012.

(51) Int. Cl.

| | |
|---|---|
| ***B65D 5/18*** | (2006.01) |
| ***B65D 5/50*** | (2006.01) |
| ***A24F 23/00*** | (2006.01) |
| ***B65B 5/08*** | (2006.01) |
| ***B65B 7/20*** | (2006.01) |
| ***B65B 43/26*** | (2006.01) |
| ***B65B 51/02*** | (2006.01) |
| ***B65D 5/42*** | (2006.01) |
| ***B65D 71/46*** | (2006.01) |

(52) U.S. Cl.
CPC ..... *B65B 43/265* (2013.01); *B65B 51/02* (2013.01); *B65D 5/18* (2013.01); *B65D 5/4212* (2013.01); *B65D 5/4266* (2013.01); *B65D 5/5023* (2013.01); *B65D 71/40* (2013.01); *B65D 71/46* (2013.01)

(58) Field of Classification Search
CPC .. B65D 5/4212; B65D 5/4266; B65D 5/5023; B65D 71/00; B65D 71/12; B65D 71/40; B65D 71/46; B65D 77/04; B65D 77/0426
USPC ..... 206/242–275, 427–434, 526; 229/103.2
See application file for complete search history.

(56) References Cited

U.S. PATENT DOCUMENTS

| | | | | | |
|---|---|---|---|---|---|
| 2,798,603 | A * | 7/1957 | Grinspoon | ..... | B65D 71/16 206/429 |
| 2,817,473 | A | 12/1957 | Foster | | |
| 2,857,048 | A | 10/1958 | Johnson | | |
| 2,899,123 | A | 8/1959 | Currie, Jr. | | |
| 3,096,880 | A | 7/1963 | Farquhar | | |
| 3,913,739 | A * | 10/1975 | Hennessey | ..... | B65D 71/12 206/434 |
| 4,941,573 | A * | 7/1990 | Fuerstman | ..... | G09F 3/00 206/459.5 |
| 8,360,235 | B2 * | 1/2013 | Gibson | ..... | B65D 50/061 206/261 |

* cited by examiner

TWO CAN PACK SLEEVE AND METHOD

RELATED APPLICATION(S)

This application is a continuation of International Application No. PCT/US2013/076358 filed on Dec. 19, 2013, and which claims priority to U.S. Patent Application No. 61/747,639, filed on Dec. 31, 2012, the entire contents of which are incorporated herein by reference.

SUMMARY

In accordance with an exemplary embodiment, a method of packaging two cylindrical cans having the same height and diameter comprises: partially erecting a sleeve from a blank so as to have a single opening at a bottom of the sleeve; arranging the two cylindrical cans side-by-side in the partially erected sleeve such that a side of each cylindrical can extends beyond an outer periphery of the sleeve; securing the cans in the sleeve by folding a cross-panel over the opening at a location between the two cans such that the opening is divided into two smaller openings sized to prevent the cans from passing therethrough, and wherein a measured distance from the cross-panel to each side panel of the sleeve in the two smaller openings is less than a diameter of one of the cylindrical cans.

In accordance with another exemplary embodiment, a package containing two cylindrical cans in a sleeve, wherein the sleeve is erected from a blank comprising a top panel and a bottom opening and wherein the two cans are arranged side-by-side in the sleeve with a portion of each can extending outward of the bottom opening in the sleeve and are secured in the sleeve by a first cross-panel extending over the bottom opening; and wherein a measured distance from the first cross-panel to each side panel of the sleeve in the bottom opening is less than a diameter of one of the two cans.

In accordance with a further exemplary embodiment, a blank for forming a sleeve operable to at least partially contain two cylindrical cans having the same height and diameter, the blank comprising: a top panel connected to a front panel along a first fold line at a top edge of the front panel and connected to a back panel along a second fold line, the second fold line extending along a top edge of the top panel; a first side panel connected to the front panel along a third fold line, the third fold line extending along a first side edge of the front panel; a second side panel connected to the front panel along a fourth fold line, the fourth fold line extending along a second side edge of the front panel; a third side panel connected to the back panel along a fifth fold line, the fifth fold line extending along a first side edge of the back panel; a fourth side panel connected to the back panel along a sixth fold line, the sixth fold line extending along a second side edge of the back panel; and a first cross-panel connected to the front panel along a seventh fold line, the seventh fold line extending along a central portion of a bottom edge of the first panel, wherein a width of the top panel is substantially the same as a height of a single cylindrical can.

FIGS. *6a-6d* are views of forming and loading an erected pack sleeve in accordance with another exemplary embodiment.

DETAILED DESCRIPTION

In accordance with an exemplary embodiment, a blank for forming a sleeve operable to contain two cylindrical cans in a single unit is disclosed. The two cans can be held securely within the sleeve such that the cans fit into conventional moist smokeless tobacco can racks located at retail outlets. The sleeve is designed to expose the lower portion of the cans so as to prevent interference from occurring on gravity feed and rail systems used in the racks. The visibility of the cans also aids consumers in identifying the product they wish to purchase.

Figure 1:
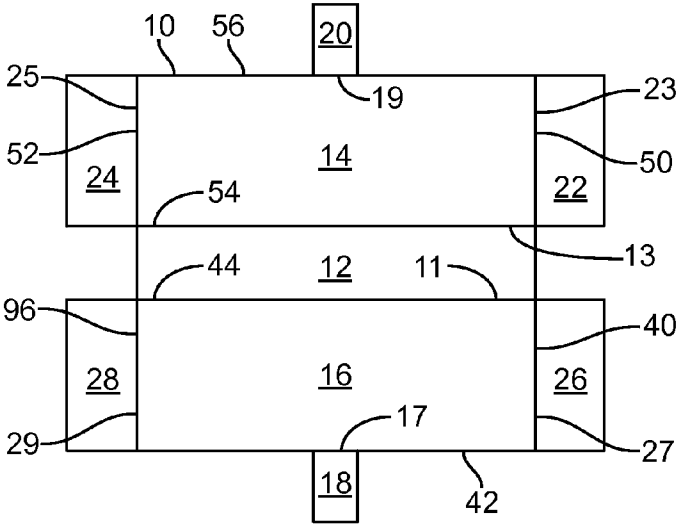
FIG. 1 is a blank for forming a pack sleeve for containing two cylindrical cans in accordance with an exemplary embodiment.

As shown in FIG. 1, the blank 10 for forming a sleeve operable to at least partially contain two cylindrical cans having the same height and diameter includes a top panel 12, a front panel 16, a back panel 14, and at least one cross-panel 18. In accordance with an exemplary embodiment, the top panel 12 is connected to the front panel 16 along a first fold line 11 at a top edge 44 of the front panel 16 and connected to a back panel 14 along a second fold line, the second fold line 13 extending along a top edge 54 of the top panel 12. A first side panel 26 is connected to the front panel 16 along a third fold line 27. The third fold line 27 extends along a first side edge 40 of the front panel 16. A second side panel 28 is connected to the front panel 16 along a fourth fold line 29. The fourth fold line 29 extends along a second side edge 46 of the front panel 16. A third side panel 22 is connected to the back panel 14 along a fifth fold line 23. The fifth fold line 23 extends along a first side edge 56 of the back panel 14. A fourth side panel 24 is connected to the back panel 14 along a sixth fold line 25. The sixth fold line 25 extends along a second side edge 52 of the back panel 14.

As shown in FIG. 1, a first cross-panel 18 is connected to the front panel 16 along a seventh fold line 17. The seventh fold line 17 extends along a central portion of a bottom edge 42 of the front panel 16. In the accordance with an exemplary embodiment, a width of the top panel 12 is substantially the same as a height of a single cylindrical can. In the alternative, the width of the top panel 12 may be approximately the height of two or more cans. In accordance with an exemplary embodiment, the first cross-panel 18 preferably has a "width" essentially equal to the width of the top panel 12 (the distance between the fold lines 11 and 13). In the alternative, the first cross-panel 18 may be greater in "width" than the top panel 12, so that a free-end portion of the cross-panel 18 maybe folded and glued against the back panel 14. In accordance with a further exemplary embodiment, the blank 10 can include a second cross-panel 20 connected to the back panel 14 along an eighth fold line 19. In accordance with an exemplary embodiment, the first cross-panel 18 and the second cross-panel 20 are substantially the same "width" and overlap one another when the sleeve 100 is assembled.

As shown in FIG. 1, the first side panel 26, the second side panel 28, the third side panel 22 and the fourth side panel 24 have substantially the same height and width. In accordance with an exemplary embodiment, a height of the front panel 16 and a height of the back panel 14 is less than the diameters of the cylindrical cans such that portions of the cylindrical cans extend beyond the bottom edge 42 of the front panel 16 and the bottom edge 54 of the back panel 14 when the cans are inserted in an erected blank 10.

Figure 2:
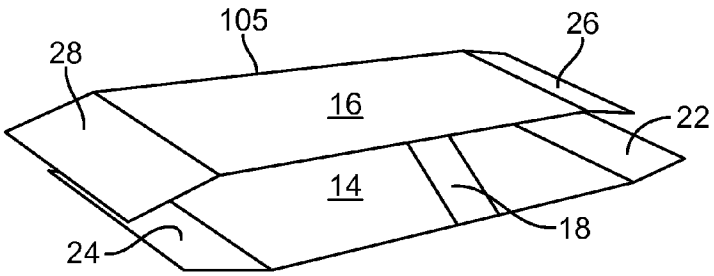
FIG. 2 is a perspective view of a partially erected blank as shown in FIG. 1.

FIG. 2 is a perspective view of a partially erected blank 10, which forms a sleeve 105 as shown in FIG. 1. As shown in FIG. 2, each of the fold lines (and/or score lines) is broken and folded over 180 degrees. In accordance with an exemplary embodiment, the first cross-panel 18 and the second cross-panel 20 are folded along the seventh fold line 17 and the eighth fold line 19 and the second cross-panel 20 is glued to the first cross-panel 18. The resultant box structure may be flattened to facilitate shipping. In accordance with an exemplary embodiment, the blank 10 is packed loose in shipping box and the first side panel 26 and the third side panel 22, and second side panel 28 and the fourth side panel 24 are folded and glued and/or taped to one another once the sleeve 105 is filled (loaded) with cans.

Figure 3:
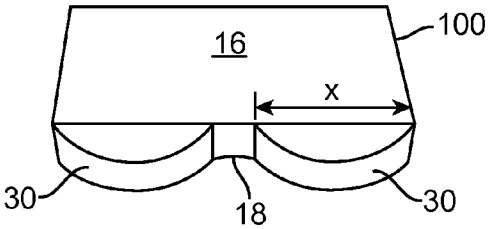
FIG. 3 is a perspective view of an erected pack sleeve containing two cylindrical cans and showing the bottom of the pack as shown in FIG. 2.
Figure 6A:
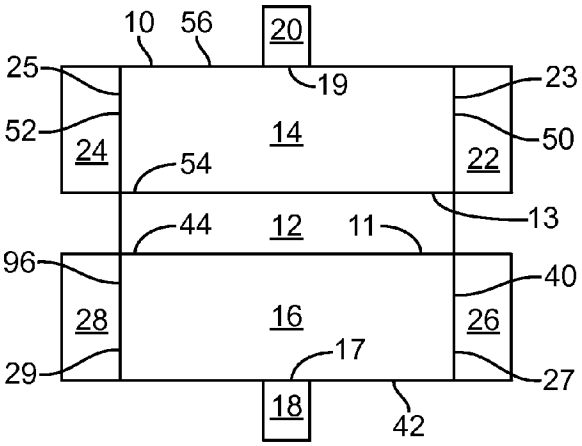

FIG. 3 is a perspective view of an erected pack sleeve 100 containing two cylindrical cans 30 and showing the bottom of the pack 100. As shown in FIG. 3, the erected pack sleeve 100 is configured to receive two cylindrical cans 30, wherein the sleeve 100 is erected from a blank 10 as shown in FIGS. 1 and 2. The two cans 30 are preferably arranged side-by-side in the sleeve 100 with a portion of each can 30 extending outward of a bottom opening in the sleeve 100 and are secured in the sleeve 100 by a cross-panel 18 extending over the bottom opening.

In accordance with an exemplary embodiment, the two cylindrical cans 30 contain moist smokeless tobacco. In an exemplary embodiment, the moist smokeless tobacco in one of the two cylindrical cans 30 is a different flavor of moist smokeless tobacco than in the other can 30. In addition, each of the two cylindrical cans 30 includes indicia indicating the contents of the cans 30 and wherein the indicia is exposed upon placement in the sleeve.

In accordance with an exemplary embodiment, a measured distance part of the erected sleeve 100 to a closest part of the sleeve 100 in the bottom opening is less than a diameter of the cylindrical can 30. For example, the measured distance (double arrow X in FIG. 3) from one of the side panels 22, 24, 26, 28 to the nearest edge of the first cross-panel 18 or the second cross-panel 20 in the opening is less than a diameter of the cylindrical can 30.

Figure 4:
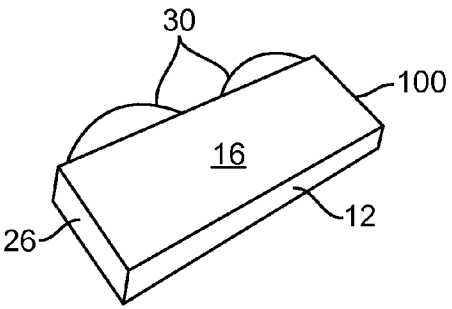
FIG. 4 is a perspective view of an erected pack sleeve containing two cylindrical cans and showing the top of the pack as shown in FIG. 2

FIG. 4 is a perspective view of an erected pack sleeve 100 containing two cylindrical cans 30 and showing the bottom of the pack 100. As shown in FIG. 4, the two cans 30 can be arranged side-by-side in the sleeve 100 with a portion of each can 30 extending outward of a bottom opening in the sleeve 100 and are secured in the sleeve 100 by a cross-panel 18 extending over the bottom opening.

Figure 5:
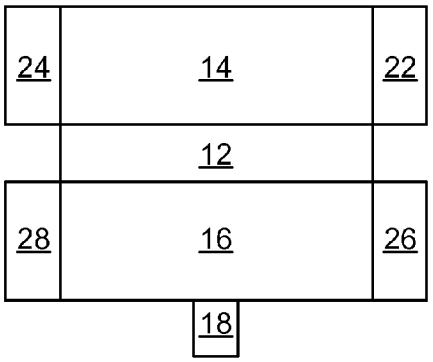
FIG. 5 is a blank for forming a pack sleeve for containing two cylindrical can in accordance with another exemplary embodiment.
Figure 6D:
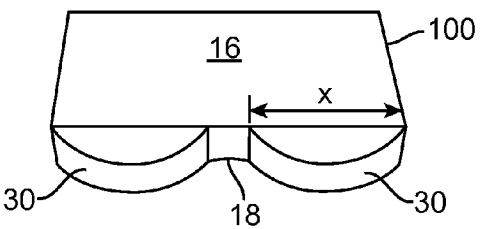
Figure 6C:
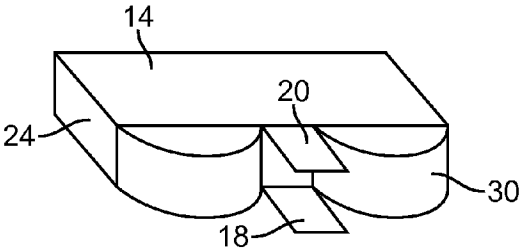
Figure 6B:
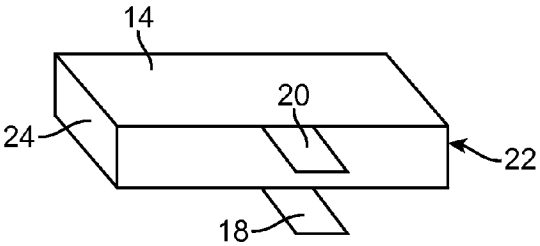

FIG. 5 is a blank 10 for forming a pack sleeve for containing two cylindrical cans in accordance with another exemplary embodiment. As shown in FIG. 5, the blank 10 for forming a sleeve 100 operable to at least partially contain two cylindrical cans 30 having the same height and diameter includes a top panel 12, a front panel 16, a back panel 14, and at least one cross-panel 18. As shown in FIG. 5, the blank 10 includes only a first cross-panel 18, which is connected to the front panel 16 along a seventh fold line 17 (FIG. 1). The seventh fold line 17 extends along a central portion of a bottom edge 42 of the front panel 16. In the accordance with an exemplary embodiment, a width of the top panel 12 is preferably substantially the same as a height of a single cylindrical can 30 (FIGS. 3 and 4), or in the alternative, multiple cans.

As shown in FIG. 5, the first side panel 26, the second side panel 28, the third side panel 22 and the fourth side panel 24 have substantially the same height and width. In accordance with an exemplary embodiment, a height of the front panel 16 and a height of the back panel 14 is less than the diameters of the cylindrical cans such that portions of the cylindrical cans extend beyond the bottom edge 42 of the front panel 16 and the bottom edge 54 of the back panel 14 when the cans are inserted in an erected blank.

In accordance with exemplary embodiment, the blank 10 is formed of a material selected from the group consisting of cardboard, paperboard, plastic, metal, or combinations thereof. For example, in a preferred embodiment, the blank 10 is formed of cardboard having a weight ranging from about 100 grams per square meter to about 350 grams per square meter.

In accordance with another exemplary embodiment, the blank 10 includes one or more of printing, embossing, debossing, embellishments and combinations thereof on an outer surface of the blank.

In the preferred embodiment, the blank 10 may be formed from any suitable materials including, but not limited to, cardboard, paperboard, plastic, metal, or combinations thereof. Preferably, the blank 10 is formed from one or more folded laminar cardboard blanks. Also preferably, the cardboard has a weight ranging from about 100 grams per square meter (gsm) to about 350 grams per square meter.

Preferably, the sleeve 100 finds particular application as a container for two or more cylindrical cans 30. Preferably, the cans 30 are cylindrical cans which contain moist smokeless tobacco. Also preferably, each can 30 has a diameter of about 66 mm. It will be appreciated that through appropriate choices of the dimensions thereof, the sleeve may be designed for different numbers of cans 30.

Preferably, the sleeve 100 has a height ranging from about 50 mm to about 60 mm, more preferably a height ranging from about 52 mm to about 58 mm. Also preferably, the height is measured from a bottom edge 42 of the front panel 16 to a top edge 56 of the back panel 14.

In the preferred embodiment, the sleeve 100 has a width ranging from about 20 mm to about 30 mm, more preferably a width ranging from about 22 mm to about 27 mm. Preferably, the width is measured from a first edge of one side wall to the second edge of the side wall.

Also preferably, the sleeve 100 has a length ranging from about 135 mm to about 145 mm, more preferably about 137 mm to about 142 mm. Preferably, the length is measure from a first side edge 40 of the front panel 16 to a second side edge 46 of the front panel 16.

In the preferred embodiment, exterior surfaces of the sleeve may be printed, embossed, debossed or otherwise embellished with manufacturer or brand logos, trademarks, slogans and other consumer information and indicia.

In another embodiment, a method for assembling the sleeve 100 from a single laminar blank 10 is provided. The laminar blank including the one or more fold lines is first partially assembled by folding it along the transverse fold lines, folding the side panels such that the side panels extending from the front panel 16 and the back panel 14 overlap on each side and gluing the side panels together to form the sleeve.

Referring now to FIGS. 6*a*-6*d*, in accordance with another exemplary embodiment, a method of packaging two cylindrical cans having the same height and diameter is disclosed. The method includes partially erecting a sleeve 100 from a blank 10 so as to have a single opening at the bottom of the sleeve; arranging the two cylindrical cans 30 side-by-side in the partially erected sleeve such that a side of each cylindrical can 30 extends beyond an outer periphery of the sleeve 100; and securing the cans 30 in the sleeve by folding a cross-panel over the opening at a location between the two cans 30 such that the opening is divided into two smaller openings sized to prevent the cans 30 from passing therethrough.

In accordance with another exemplary embodiment, the method includes wherein the partially erecting step includes folding the blank 10 along the first fold line 11 and the second fold line 12 so that the front panel 16 and the back panel 14 extend downwardly from the top panel 12. The partially erecting step further includes folding the blank 10 along the first fold line 23 and the third fold line 27 such that the first side panel 26 and the third side panel 22 overlap and applying glue to one or more of the first side panel 26 and the third side panel 22 to adhere the first side panel 26 and the third side panel 22 together. In accordance with another exemplary embodiment, the partially erecting step further includes folding the blank 10 along the fourth fold line 29 and the sixth fold line 25 such that the second side panel 28 and the fourth side panel 24 overlap and applying glue to one or more of the second side panel 28 and the fourth side panel 24 to adhere the second side panel 28 and the fourth side panel 24 together. The method further includes gluing the first cross-panel 18 to the back panel 14 such that the first cross-panel 18 secures the cans 30 within the sleeve 100. In accordance with an exemplary embodiment, the width of the top panel 12 is substantially the same as the height of the two cylindrical cans 30.

In accordance with another exemplary embodiment, a second cross-panel 20 is connected to the back panel 14 along an eighth fold line 19 and wherein the method further includes folding the first cross-panel 18 and the second cross-panel 20 over the opening and gluing the first cross-panel 18 to the second cross-panel 20 such that the cross-panels 18, 20 secure the cans 30 within the sleeve 100.

In the same or a separate process to the partial assembly described above, the consumer goods are then inserted into the inner slide through one of the open sides. The side panels 22, 24, 26, 28 are then folded along the fold lines 23, 25, 27, 29 and glued together on each side of the sleeve 100.

As used herein, the terms "front", "back", "upper, "lower", "side", "top", "bottom", "left", "right" and other terms used to describe relative positions of the components of the sleeve refer to the sleeve in an upright position.

As used herein, the term "can" refers to any disc-like container, regardless of material comprising the container and regardless of its content.

As used herein, the term "longitudinal" refers to a direction from bottom to top or vice versa of the sleeve 100. The term "transverse" refers to a direction perpendicular to the longitudinal direction.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a sleeve. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A method of packaging two cylindrical cans having the same height and diameter comprising:

partially erecting a sleeve from a blank so as to have a single opening at a bottom of the sleeve, the blank comprising a top panel, a front panel, a back panel, and a bottom opening, the front panel and the back panel each having a pair of side panels;

arranging the two cylindrical cans side-by-side in the partially erected sleeve such that a side of each cylindrical can extends beyond an outer periphery of the sleeve;

securing the cans in the sleeve by folding a cross-panel over the opening at a location between the two cans such that the opening is divided into two smaller openings sized to prevent the cans from passing therethrough, and wherein a measured distance from the cross-panel to each side panel of the sleeve in the two smaller openings is less than a diameter of one of the cylindrical cans, and wherein heights of the front panel, the back panel, and the side panels are equal.

2. The method of claim 1, wherein the blank comprises:

the top panel connected to the front panel along a first fold line at a top edge of the front panel and connected to the back panel along a second fold line, the second fold line extending along a top edge of the back panel;

the pair of side panels for the back panel and the front panel comprising:

a first side panel connected to the front panel along a third fold line, the third fold line extending along a first side edge of the front panel;

a second side panel connected to the front panel along a fourth fold line, the fourth fold line extending along a second side edge of the front panel;

a third side panel connected to the back panel along a fifth fold line, the fifth fold line extending along a first side edge of the back panel;

a fourth side panel connected to the back panel along a sixth fold line, the sixth fold line extending along a second side edge of the back panel; and the cross-panel comprises a first cross-panel connected to the front panel along a seventh fold line, the seventh fold line extending along a central portion of a bottom edge of the first panel, wherein the partially erecting step includes folding the blank along the first fold line and the second fold line so that the front panel and the back panel extend downwardly from the top panel.

3. The method of claim 2, wherein the partially erecting step further includes folding the blank along the third fold line and the fifth fold line such that the first side panel and the third side panel overlap and applying glue to one or more of the first side panel and the third side panel to adhere the first side panel and the third side panel together.

4. The method of claim 2, wherein the width of the top panel is substantially the same as the height of the two cylindrical cans.

5. The method of claim 2, further comprising a second cross-panel connected to the back panel along an eighth fold line and wherein the method further includes folding the first cross-panel and the second cross-panel over the opening and gluing the first cross-panel to the second cross-panel such that the cross-panels secure the cans within the sleeve.

6. The method of claim 3, wherein the partially erecting step further includes folding the blank along the fourth fold line and the sixth fold line such that the second side panel and the fourth side panel overlap and applying glue to one or more of the second side panel and the fourth side panel to adhere the second side panel and the fourth side panel together.

7. The method of claim 1, further including gluing the first cross-panel to the back panel such that the first cross-panel secures the cans within the sleeve.

8. A package containing two cylindrical cans in a sleeve, wherein the sleeve is erected from a blank comprising a top panel, a front panel, a back panel, and a bottom opening, the front panel and the back panel each having a pair of side panels, and wherein the two cans are arranged side-by-side in the sleeve with a portion of each can extending outward of the bottom opening in the sleeve and are secured in the sleeve by a first cross-panel extending over the bottom opening; and wherein a measured distance from the first cross-panel to each side panel of the sleeve in the bottom opening is less than a diameter of one of the two cans, and wherein heights of the front panel, the back panel, and the side panels are equal.

9. The package of claim 8, wherein the blank comprises:

the top panel connected to the front panel along a first fold line at a top edge of the front panel and connected to the back panel along a second fold line, the second fold line extending along a top edge of the back panel;

the pair of side panels for the back panel and the front panel comprising:

a first side panel connected to the front panel along a third fold line, the third fold line extending along a first side edge of the front panel;

a second side panel connected to the front panel along a fourth fold line, the fourth fold line extending along a second side edge of the front panel;

a third side panel connected to the back panel along a fifth fold line, the fifth fold line extending along a first side edge of the back panel; and a fourth side panel connected to the back panel along a sixth fold line, the sixth fold line extending along a second side edge of the back panel; and the first cross-panel connected to the front panel along a seventh fold line, the seventh fold line extending along a central portion of a bottom edge of the first panel.

10. The package of claim 8, wherein the two cylindrical cans contain moist smokeless tobacco.

11. The package of claim 10, wherein the moist smokeless tobacco in one of the two cylindrical cans is a different flavor of moist smokeless tobacco than in the other can.

12. The package of claim 8, wherein each of the two cylindrical cans includes indicia indicating the contents of the cans and wherein the indicia is exposed.

13. A blank for forming a sleeve operable to at least partially contain two cylindrical cans having the same height and diameter, the blank comprising:

a top panel connected to a front panel along a first fold line at a top edge of the front panel and connected to a back panel along a second fold line, the second fold line extending along a top edge of the top panel;

a first side panel connected to the front panel along a third fold line, the third fold line extending along a first side edge of the front panel;

a second side panel connected to the front panel along a fourth fold line, the fourth fold line extending along a second side edge of the front panel;

a third side panel connected to the back panel along a fifth fold line, the fifth fold line extending along a first side edge of the back panel;

a fourth side panel connected to the back panel along a sixth fold line, the sixth fold line extending along a second side edge of the back panel; and a first cross-panel connected to the front panel along a seventh fold line, the seventh fold line extending along a central portion of a bottom edge of the front panel, wherein a width of the top panel is substantially the same as a height of a single cylindrical can, and heights of the front panel, the back panel, and the first, second, third, and fourth side panels are equal.

14. The blank of claim 13, wherein the blank is formed of a material selected from the group consisting of cardboard, paperboard, plastic, metal, or combinations thereof.

15. The blank of claim 14, wherein the blank is formed of cardboard having a weight ranging from about 100 grams per square meter to about 350 grams per square meter.

16. The blank of claim 13, wherein the blank includes one or more of printing, embossing, debossing, embellishments and combinations thereof on an outer surface of the blank.

17. The blank of claim 13, wherein the first cross-panel has a width greater than the width of the top panel.

18. The blank of claim 13, further including a second cross-panel connected to the back panel along an eighth fold line.

19. The blank of claim 18, wherein the first cross-panel and the second cross-panel are substantially the same length.

20. The blank of claim 13, wherein the height of the front panel and the height of the back panel are each less than the diameters of the cylindrical cans such that portions of the cylindrical cans extend beyond the bottom edge of the front panel and the bottom edge of the back panel when the cans are inserted in the blank when erected.

* * * * *